US005195467A

United States Patent [19]

Kurz

[11] Patent Number: 5,195,467

[45] Date of Patent: Mar. 23, 1993

[54] THERMOSTATIC VALVE FOR CONTROLLING COOLANT TEMPERATURE OF AN INTERNAL-COMBUSTION ENGINE

[75] Inventor: Manfred Kurz, Ditzingen, Fed. Rep. of Germany

[73] Assignee: Behr-Thompson-Dehnstoffregler GmbH & Co., Fed. Rep. of Germany

[21] Appl. No.: 814,839

[22] Filed: Dec. 31, 1991

[30] Foreign Application Priority Data

Jan. 8, 1991 [DE] Fed. Rep. of Germany ..... 4100310
Feb. 27, 1991 [DE] Fed. Rep. of Germany ..... 4106081

[51] Int. Cl.[5] ..... F01P 7/14
[52] U.S. Cl. ..... 123/41.1; 236/34.5
[58] Field of Search ..... 123/41.08, 41.09, 41.1; 236/34, 34.5, 99 C, 99 E, 101 B, 101 C, 102

[56] References Cited

U.S. PATENT DOCUMENTS 2,425,439 8/1947 Puster ..... 236/34.5
2,788,176 4/1957 Andersen ..... 236/34.5
2,975,973 3/1961 Carroll ..... 236/34.5
2,988,280 6/1961 Kimm et al. ..... 236/34.5

FOREIGN PATENT DOCUMENTS 3226104 2/1985 Fed. Rep. of Germany .
3504653 8/1987 Fed. Rep. of Germany .

*Primary Examiner*—Noah P. Kamen
*Attorney, Agent, or Firm*—Evanson, Wands, Edwards, Lenahan & McKeown

[57] ABSTRACT

In the case of a thermostatic valve for controlling the temperature of the coolant, particularly of a motor vehicle engine, it is provided that the working piston of the thermostatic valve is supported on a piston of a thermostatic working element which is aligned coaxially with respect to the working piston and serves as the supporting body. A restoring device is provided which is supported against the working piston and against the piston of the thermostatic working element.

16 Claims, 1 Drawing Sheet

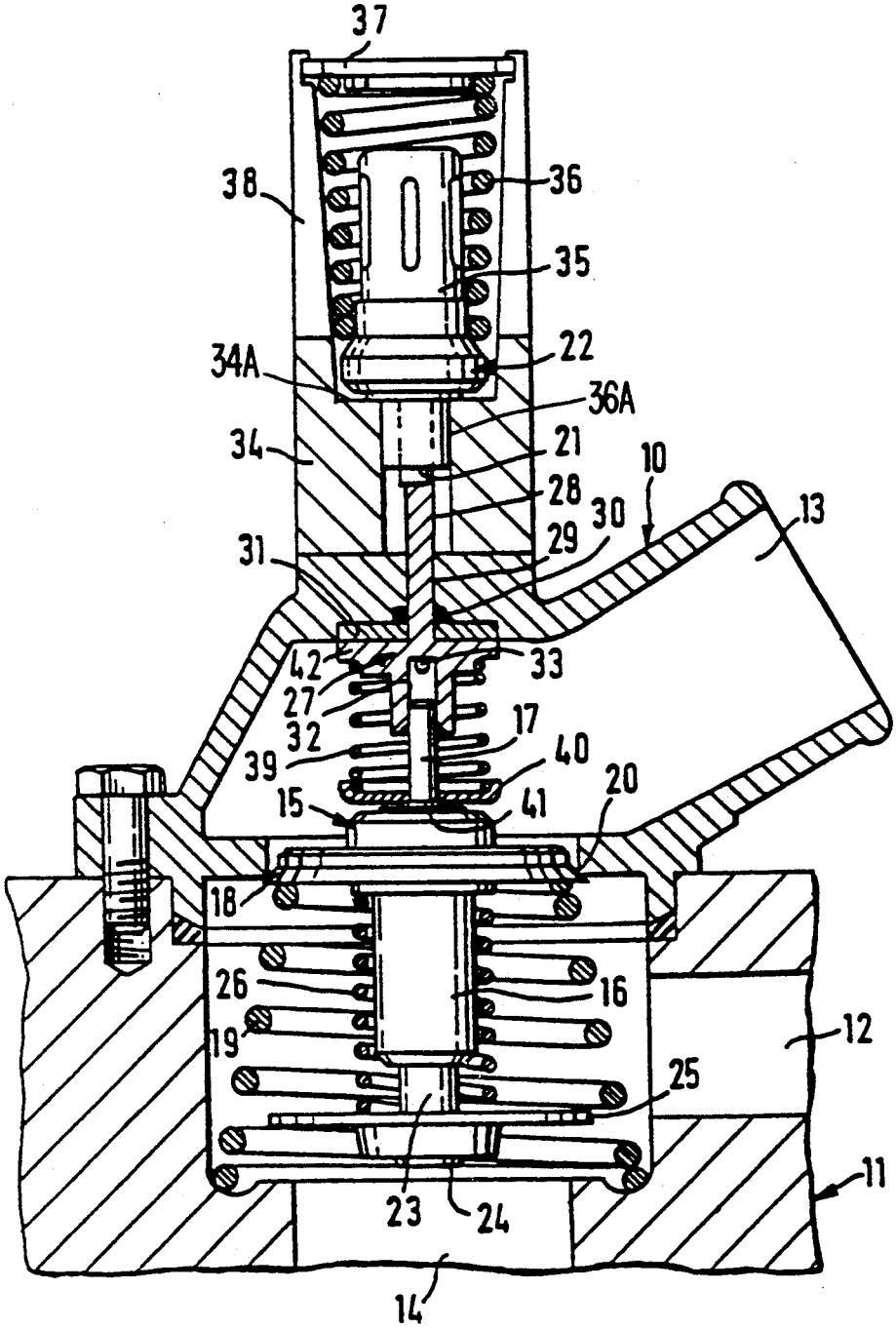
37
38
36
35
34A
22
36A
34
21
10
28
30
13
29
31
42
33
27
32
17
39
40
15
41
20
18
26
16
19
12
25
11
23
24
14

THERMOSTATIC VALVE FOR CONTROLLING COOLANT TEMPERATURE OF AN INTERNAL-COMBUSTION ENGINE

BACKGROUND AND SUMMARY OF THE INVENTION

This invention relates to a thermostatic valve for controlling the temperature of the coolant of an internal-combustion engine, particularly of a motor vehicle engine. The invention relates particularly to a thermostatic valve which has a working piston, a piston supporting body which can be adjusted by means of an adjusting element, and an elastic restoring device which restores the working piston away from the supporting body.

In the case of a known thermostatic valve of the initially mentioned type disclosed in German Patent Document DE-C 35 04 653, an electric motor is provided as the adjusting element which adjusts a supporting body constructed as an eccentric. The elastic restoring device for the working piston of the thermostatic valve is supported on this working piston and on the valve housing in such a manner that it presses the working piston when the coolant temperature falls back into its inoperative position. This ensures that there are no undesirable operating conditions of the thermostatic valve and thus of the internal-combustion engine.

It is also known from German Patent Document DE-A 32 26 104 to provide as the supporting body a piston of a thermostatic working element which is aligned coaxially with the working piston of the thermostatic valve.

It is an object of the invention to provide a construction of a thermostatic valve of the initially mentioned type that is as simple as possible.

This object is achieved in that the supporting body is a piston of a thermostatic working element which is aligned coaxially with respect to the working piston, and in that the restoring device is supported against the working piston and against the piston of the thermostatic working element.

By using a thermostatic working element as the adjusting element and its piston as the supporting body, a simplification of the construction is achieved. By means of the special arrangement of the restoring device, it is additionally achieved that the working piston as well as the piston of the thermostatic working element are each restored into their initial positions when the coolant temperature and temperature to which the thermostatic working element is exposed. The restoring is therefore achieved by means of only one restoring device so that the construction is simplified further. By means of this restoring device, it is ensured that undesirable operating conditions of the internal-combustion engine are avoided which are the result of undesirable working positions of the thermostatic valve.

In a further development of the invention, it is provided that a transmission element is arranged between the piston of the thermostatic working element and the working piston, which transmission element presets an idle path and transmits pressure forces. A transmission element of this type offers further possibilities for simplifying the construction.

Other objects, advantages and novel features of the present invention will become apparent from the following detailed description of the invention when considered in conjunction with the accompanying drawings.

BRIEF DESCRIPTION OF THE DRAWINGS

The single drawing figure is an axial sectional view of a thermostatic valve constructed according to the invention which takes up the operating position when the coolant is cold.

DETAILED DESCRIPTION OF THE DRAWINGS

The illustrated thermostatic valve has a valve housing which is formed of two parts 10, 11 and is provided with three cooling water connections 12, 13, 14. When the thermostatic valve is arranged in the forward flow between an internal-combustion engine and a radiator, connection 12 is used for the supply of coolant from the internal-combustion engine, connection 13 is used for the conveying of the coolant to a radiator, and connection 14 is used for connecting a short-circuit line bypassing the radiator. A thermostatic valve of this type, which is known in its basic construction, may also be arranged in the return flow line from a radiator to an internal-combustion engine. In this case, connection 12 would lead to the internal-combustion engine, while connection 13 would be intended for a line coming from the radiator.

Inside this valve housing 10, 11, a first thermostatic working element 15 is arranged which contains an expansion substance in a housing 16, particularly a wax. This expansion substance expands when it is heated, starting from a preset temperature, in such a manner that a working piston 17 is driven out of the housing 16. On a ring collar of the housing 16, a valve disk 18 is mounted which is pressed by means of a closing spring 19 against a valve seat 20 formed by the part 10 of the valve housing. The moving-out working piston 17 is supported, in a manner which will be described in the following, on a piston 21 of a second thermostatic working element 22 which serves as the supporting body. A farther moving of the working piston 17 out of its housing 16 then leads to an escape movement of its housing 16 and thus to a lifting of the valve disk 18 off the valve seat 20 and thus to an opening of the thermostatic valve. In a known manner, a pin 23 is mounted on the housing 16 on which a short-circuit valve disk 25 is slidingly guided which is secured by means of a securing disk 24. The short-circuit valve disk 25 is held by means of a coil spring 26 in the shown position on the securing ring 24. When the housing 16 is displaced for the opening of the valve 18, 20, the short-circuit valve disk 25 is placed in front of connection 14 and thus closes the short-circuit line. When the housing 16 is displaced farther, the short-circuit disk 25 slides onto the pin 23.

As mentioned above, the working piston 17 is supported against a piston 21 of the second thermostatic working element 22 serving as the supporting body. The thermostatic working element 22 is arranged in such a manner that its piston 21 is aligned coaxially with respect to the working piston 17. The supporting between the workinq piston 17 and the piston 21 takes place indirectly by way of a transmission element 27 which is essentially arranged inside part 10 of the valve housing and penetrates it by means of a piston-type projection 28 in a bore 29. The piston-type projection 28, which is supported against the piston 21, is surrounded by a sealing ring 30 placed in a recess of part 10. The sealing ring 30 is held by means of a plate 31 inserted in part 10 of the valve housing.

The transmission element 27 has a guide bore 32, which is chamfered on its open end and receives the working piston 17. The axial depth of the guide bore 32 is dimensioned such that the working piston 17, during its moving-out movement out of its housing 16, must first cover an idle path until it is supported on the bottom of the guide bore 32. It is only then that a farther moving-out of the working piston 17 results in a movement of the housing 16 and of the valve disk 18 mounted on it. The guide bore 32 is open toward the coolant surrounding it so that the movement of the working piston 17 is not impaired by coolant penetrating into the guide bore 32. For this purpose, a transverse bore 33 is provided in the area of the closed end of the guide bore 32.

The second thermostatic working element 22 is held in a housing part 34 which is detachably fastened to part 10 of the valve housing. The thermostatic working element 22 has a housing 35 which contains an expansion substance, particularly wax. When this expansion substance is heated to a predetermined temperature, the piston 21 is driven out. The housing 35 is provided with a guide projection 36A which is coaxial with respect to the piston 21 and by means of which it is guided in a bore of the housing part 34. By means of a lift-over spring 36, the housing 35 is held in the shown basic position in which it rests against a ring shoulder 34A of the housing 34. The lift-over spring 36, which is constructed as a conical coil spring, is supported against a securing disk 37 which is held by axial webs 38 of the housing part 34. The lift-over spring 36 is prestressed and designed such that it applies a clearly higher force than the also prestressed closing spring 19. The respective position of the thermostatic valve is therefore not influenced by the lift-over spring 36.

When the coolant temperature is cold, the thermostatic valve is in the illustrated position. Starting from a predetermined coolant temperature, the working piston 17 is moved out of the housing 16. As soon as it places itself on the bottom of the guide bore 32, the opening of the thermostatic valve will start and thus the flowing of the coolant through the radiator which is not shown. A further control variable is superposed on this control which is caused by the coolant temperature of the internal-combustion engine, and this control variable is detected by the second thermostatic working element 22. This second thermostatic working element 22 is subjected to the ambient temperature, particularly the engine compartment temperature of a motor vehicle. As soon as this temperature has reached and exceeded a predetermined value for which the expansion substance contained in the housing is designed, the piston 21 of this thermostatic working element 22 is moved out so that the supporting point for the working piston 17 is shifted, whereby the thermostatic valve is opened farther or the beginning of the opening is shifted to another temperature level.

In order to ensure that defined starting conditions are always obtained, it is provided that the working piston 17 as well as the piston 21 are restored to their starting position when the temperatures fall which are detected by each of them. This takes place by means of a common, prestressed restoring spring 39 which, in the manner of an expansion spring, is arranged between the working piston 17 and the piston 21. The restoring spring 39, which is constructed as a coil spring, is supported on a spring plate 40 which, by means of a securing ring 41, is held on the working piston 17. On the piston 21 of the second thermostatic working element 22, the restoring spring 39 is supported indirectly by way of the transmission element 21. A spring plate 42 is molded onto the transmission element 27. The restoring spring 39 presses the working piston 17 into its housing 16 until the securing ring 41 comes to rest on the housing 16. Likewise, the restoring spring 39 presses the transmission element 27 back and thus presses the piston 21 into its housing 35 until the back side of the spring plate 42 comes to rest on the plate 31. The restoring spring 39 is prestressed and dimensioned such that the force applied by it is clearly weaker than the force of the closing spring 19 and of the lift-over spring 36.

The use of the transmission element 27, which is predominantly arranged inside part 10 of the valve housing, has the advantage that the housing part 34 with the second thermostatic working element 22 can be detached from part 10 of the valve housing without any loss of the tightness of the thermostatic valve. In addition, by means of this arrangement, the basic function of the thermostatic valve is maintained, even when the second thermostatic working element 22 is removed or should have fallen out.

In the shown embodiment, the second thermostatic working element 22, that is, its housing 35 is subjected to the ambient temperature. In the case of a modified embodiment, it is provided that the housing 35 of the thermostatic working element 22 is heated by means of a heating device so that other regulating or control variables may also be used for controlling the temperature of the coolant of the internal-combustion engine.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A thermostatic valve for controlling the temperature of the coolant of an internal-combustion engine, particularly of a motor vehicle engine, comprising:

a movable valve member for controlling a flow opening, a working piston connected to the valve member for movement with the valve member, a first thermostatic working element for controlling the position of the working piston in response to coolant temperature of coolant acting on the first thermostatic working element, a supporting body assigned to the working piston for controlling an end position of the working piston, an adjusting element for adjusting the position of the supporting body, and an elastic restoring device for restoring the working piston away from the supporting body, wherein the supporting body is a piston of a second thermostatic working element which forms the adjusting element and is aligned coaxially with respect to the working piston, and wherein the elastic restoring device is supported against the working piston and against the piston of the second thermostatic working element.

2. A thermostatic valve according to claim 1, wherein a transmission element is arranged between the piston of the second thermostatic working element and the working piston, which transmission element presets an idling path and transmits pressure forces.

3. A thermostatic valve according to claim 2, wherein the transmission element is guided out of a valve housing of the thermostatic valve by means of a piston-type projection surrounded by a sealing device, the projection being supported against the piston of the second thermostatic working element fastened to the valve housing.

4. A thermostatic valve according to claim 3, wherein the transmission element has a receiving bore for the working piston that is coaxial with respect to the piston-type projection.

5. A thermostatic valve according to claim 4, wherein the second thermostatic working element is held in a housing part which is detachably mounted on the valve housing.

6. A thermostatic valve according to claim 3, wherein the elastic restoring device is arranged between a spring plate of the transmission element and a spring plate mounted on the working piston.

7. A thermostatic valve according to claim 2, wherein the transmission element has a receiving bore for the working piston that is coaxial with respect to the piston-type projection.

8. A thermostatic valve according to claim 7, wherein the receiving bore is provided with an opening at least in the area of its closed end.

9. A thermostatic valve according to claim 2, wherein the elastic restoring device is arranged between a spring plate of the transmission element and a spring plate mounted on the working piston.

10. A thermostatic valve according to claim 9, wherein the spring plate of the transmission element is arranged inside the valve housing opposite a stop surface.

11. A thermostatic valve according to claim 10, wherein the second thermostatic working element is held in a housing part which is detachably mounted on the valve housing.

12. A thermostatic valve according to claim 11, wherein a housing of the second thermostatic working element is guided by means of a projection, which is coaxial with respect to its piston, in the housing part and is held in the housing part by means of a prestressed lift-over spring.

13. A thermostatic valve according to claim 1, wherein the second thermostatic working element is held in a housing part which is detachably mounted on the valve housing.

14. A thermostatic valve according to claim 13, wherein a housing of the second thermostatic working element is guided by means of a projection, which is coaxial with respect to its piston, in the housing part and is held in the housing part by means of a prestressed lift-over spring.

15. A thermostatic valve according to claim 2, wherein the second thermostatic working element is held in a housing part which is detachably mounted on the valve housing.

16. A thermostatic valve according to claim 15, wherein a housing of the second thermostatic working element is guided by means of a projection, which is coaxial with respect to its piston, in the housing part and is held in the housing part by means of a prestressed lift-over spring.

* * * * *